US009573252B1

(12) United States Patent
Lee et al.

(10) Patent No.: US 9,573,252 B1
(45) Date of Patent: Feb. 21, 2017

(54) MULTIPLE SIZE NUT DRIVER

(71) Applicants: David M. Lee, Westminister, CA (US); Uttaran Hazarika, Pune (IN)

(72) Inventors: David M. Lee, Westminister, CA (US); Uttaran Hazarika, Pune (IN)

( * ) Notice: Subject to any disclaimer, the term of this patent is extended or adjusted under 35 U.S.C. 154(b) by 512 days.

(21) Appl. No.: 14/275,411

(22) Filed: May 12, 2014

Related U.S. Application Data

(60) Provisional application No. 61/822,322, filed on May 11, 2013.

(51) Int. Cl.
*B25B 13/00* (2006.01)
*B25B 13/10* (2006.01)
*B25B 13/06* (2006.01)

(52) U.S. Cl.
CPC ..... *B25B 13/102* (2013.01); *B25B 13/06* (2013.01)

(58) Field of Classification Search
CPC ..... B25B 13/102; B25B 13/105
USPC ..... 81/124.5
See application file for complete search history.

(56) References Cited

U.S. PATENT DOCUMENTS 294,413 A * 3/1884 Stanton ..... B25B 13/102 81/185
1,346,161 A 7/1920 Rosenberg
1,896,949 A 2/1933 Greiner
3,285,106 A 11/1966 Svenson
6,330,844 B1 12/2001 Walker
6,467,379 B1 10/2002 Wizman
6,637,298 B1 10/2003 O'Brien
6,732,615 B2 * 5/2004 Layaou ..... B25B 13/102 81/124.5
7,150,209 B1 12/2006 Loomis
9,308,629 B2 * 4/2016 Gadd ..... B25B 15/008

OTHER PUBLICATIONS

Select-a-Socket Multi Wrench, sold by GadgetsGo.com, http://gadgetsgo.com/Multiple-head-socket-ratchet-tool.html, and https://www.youtube.com/watch?v=VetyKs62k61, Jan. 29, 2013.

* cited by examiner

*Primary Examiner* — Bryan R Muller
(74) *Attorney, Agent, or Firm* — Quickpatents, LLC; Kevin Prince

(57) ABSTRACT

A nut driver for driving a nut within a range of nut sizes includes a housing. An open driver end thereof assumes a largest size of the nut sizes, and a selector end thereof terminates in a rotational knob that is positionable at any of a number of selectable radial positions. A cam is rotationally fixed with the knob and within the housing and terminates at a forward end with a selector ramp. A plurality of plungers are each slidably fixed within the housing and at a rear end thereof engage the selector ramp. Each plunger terminates at a forward end at a notched socket selector. A plurality of nested sockets each assume one of the different nut sizes and are slidably movable by at least one of the elongated plungers between a forward position within the open driver end of the housing and a rearward position.

9 Claims, 8 Drawing Sheets

MULTIPLE SIZE NUT DRIVER

CROSS-REFERENCE TO RELATED APPLICATIONS

This application claims the benefit of U.S. Provisional Patent Application 61/822,322, filed on May 11, 2013, and incorporated herein by reference.

STATEMENT REGARDING FEDERALLY SPONSORED RESEARCH AND DEVELOPMENT

Not Applicable.

FIELD OF THE INVENTION

This invention relates to tools, and more particularly to an adjustable nut driver.

DISCUSSION OF RELATED ART

When using tools, finding a desired socket size for driving a hex nut, bolt, or other type of fastener is sometimes frustrating. Individual sockets often get separated from a set of sockets, resulting in some of the sockets being missing when needed. Further, each socket must be selected, checked for size with the nut, and then returned to the set if not the correct size. The same individual socket may be inadvertently tried several times before the user realizes it, delaying the finishing of the project at hand.

The prior art shows a number of socket-type tools that have nested sockets that slide axially out the way of each other to reveal the correct socket for a particular hex nut, for example. U.S. Pat. No. 1,346,061 to Rosenberg on Jul. 6, 1920 teaches one such device, wherein a plurality of nested sockets can be manually slid forward or rearward to reveal a selected socket. Examples of similar devices include those taught in U.S. Pat. No. 1,896,949 to Greiner on Feb. 7, 1933; U.S. Pat. No. 3,285,106 to Svenson on Nov. 15, 1966; U.S. Pat. No. 6,467,379 to Wizman on Oct. 22, 2002; U.S. Pat. No. 6,637,298 to O'Brien et al. on Oct. 28, 2003, and U.S. Pat. No. 7,150,209 to Loomis et al. on Dec. 19, 2006. With all such devices, the nested sockets are elastically urged forward by a spring mechanism, by gravity, or by direct manual adjustment. Such devices have the inherent problem of even slight mis-alignment with the nut to be rotated both axially and laterally; that is, if the axis of the nut and the axis of the tool are laterally misaligned, then when the tool is applied to the nut the correctly-sized socket will contact the nut unintentionally and be retracted. Likewise, if the socket is not rotationally aligned with the tool, the corners of the hex nut (for example) will also contact the correct socket and cause it to retract. In both cases the selected socket will be too large to properly rotate the nut, or not properly sized so as to damage the nut or the tool itself.

Another prior art device, sold under the brand name "Select-a-Socket" by GadgetsGo.com of Miamai Beach, Fla., includes nested sockets that slide axially out the way of each other to reveal the correct socket for a particular hex nut. A selector holds the selected socket and the larger sockets in place, but releases the smaller sockets that are spring-biased into a forward position. With such a device it is not possible to see the selected socket visually since the non-selected sockets are only retracted by pressure from the hex nut. Therefore, if one has difficulty reading the selected size on the side of such a tool, or difficulty imagining the size of a selected socket, the correct size may take some time to discover. Further, the correct rotational orientation of the tool with the bolt head is also more difficult to see when all of the sockets are biased into a forward position.

Therefore, there is a need for a device that includes a number of different socket sizes within a range of sizes, and wherein the socket size may be readily set by the user. Such a needed device would allow the user to sequence through a number of socket sizes in an orderly manner without repeating a particular size inadvertently, until the correct size is found. Such a needed invention would maintain all of the sockets together in one light-weight and relatively inexpensive to manufacture tool, and would replace a typical 5 to 7 piece nut driver set. Further, such a needed device would not allow a non-selected size of socket to be inadvertently retracted due to misalignment of the nut and the tool, and the non-selected sockets would be retracted so that visual discernment of the rotational orientation and the selection of the desired sized sockets would be facilitated. The present invention accomplishes these objectives.

SUMMARY OF THE INVENTION

The present device is a nut driver for driving a nut within a range of nut sizes all having a consistent perimeter shape. For example, the perimeter shape may be a hexagon for driving a hexagonal nut, herein understood to refer to a nut, bolt, or other hexagon-shaped fastener.

A rigid elongated housing has a driver end and a selector end. The driver end is open and assumes a largest size of the perimeter shape. The selector end terminates in a rotational knob that is positionable at any of a number of selectable radial positions, each of which are associated with a different nut size within the range of nut sizes. A cam is rotationally fixed with the rotational knob and within the housing. The cam terminates at a forward end with a selector ramp.

A plurality of elongated plungers are each slidably fixed within the housing. Each plunger is adapted at a rear end thereof for engagement with the selector ramp of the cam. Each plunger terminates at a forward end thereof at a notched socket selector.

A plurality of nested sockets each have the perimeter shape and one of the different nut sizes within the range of nut sizes. Each socket is slidably movable by at least one of the elongated plungers between a forward position within the open driver end of the housing and a rearward position.

In use, the rotational knob is turned from one of the selectable radial positions to the next, the selector ramp engaging one of the plungers to push one or more of the outermost nested sockets into their forward positions within the open driver end of the housing.

The present invention is a device that includes a number of different socket sizes within a range of sizes, and wherein the socket size may be readily set by the user. The present device allows the user to sequence through a number of socket sizes in an orderly manner without repeating a particular size inadvertently, until the correct size is found. The present invention maintains all of the sockets together in one light-weight and relatively inexpensive to manufacture tool that is further easy to use and store. Further, the present device provides for the non-selected sockets to be retracted so that visual discernment of the rotational orientation of the tool and the selection of the desired sized sockets is facilitated. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
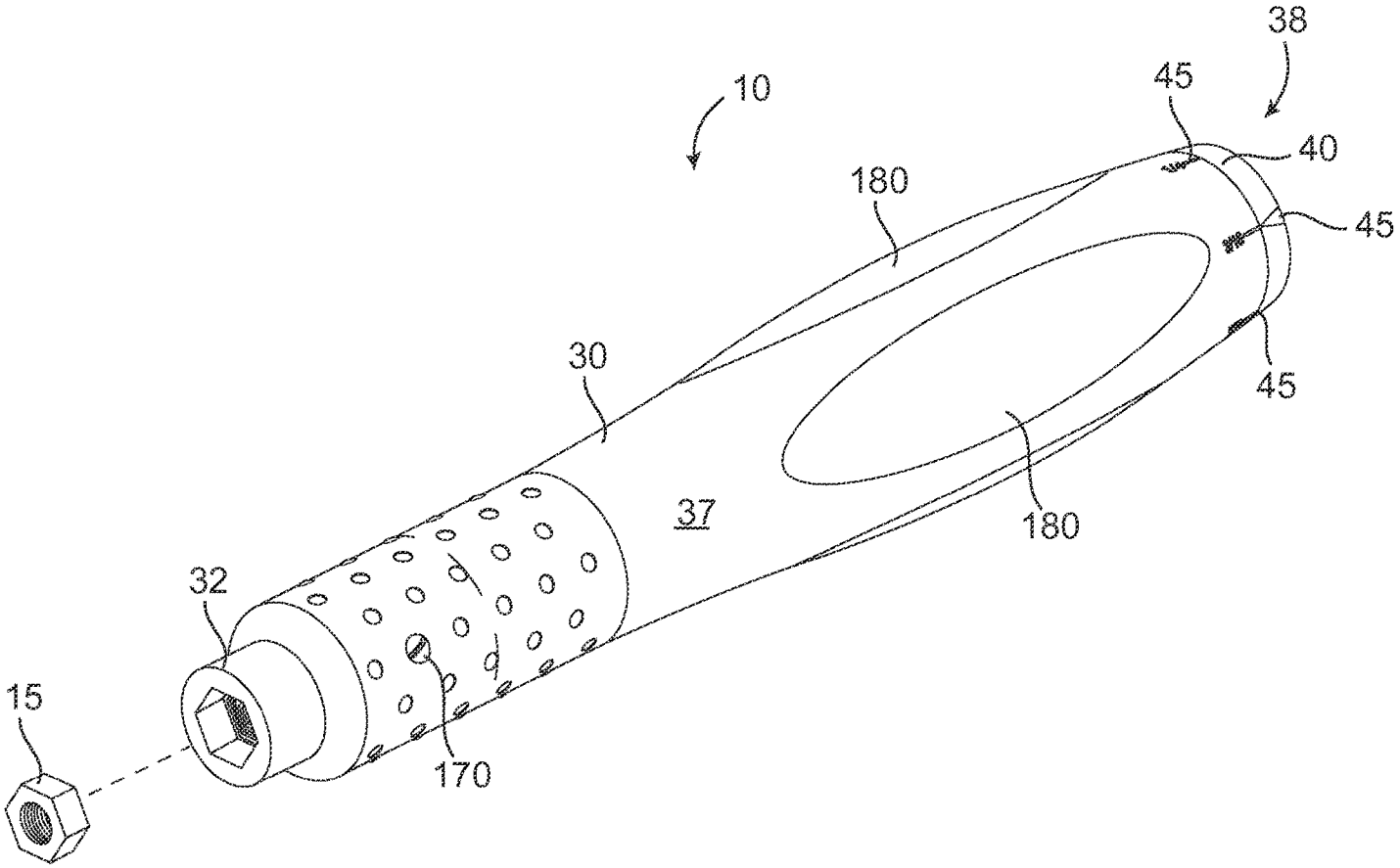
FIG. 1 is a perspective view of the invention.
Figure 3:
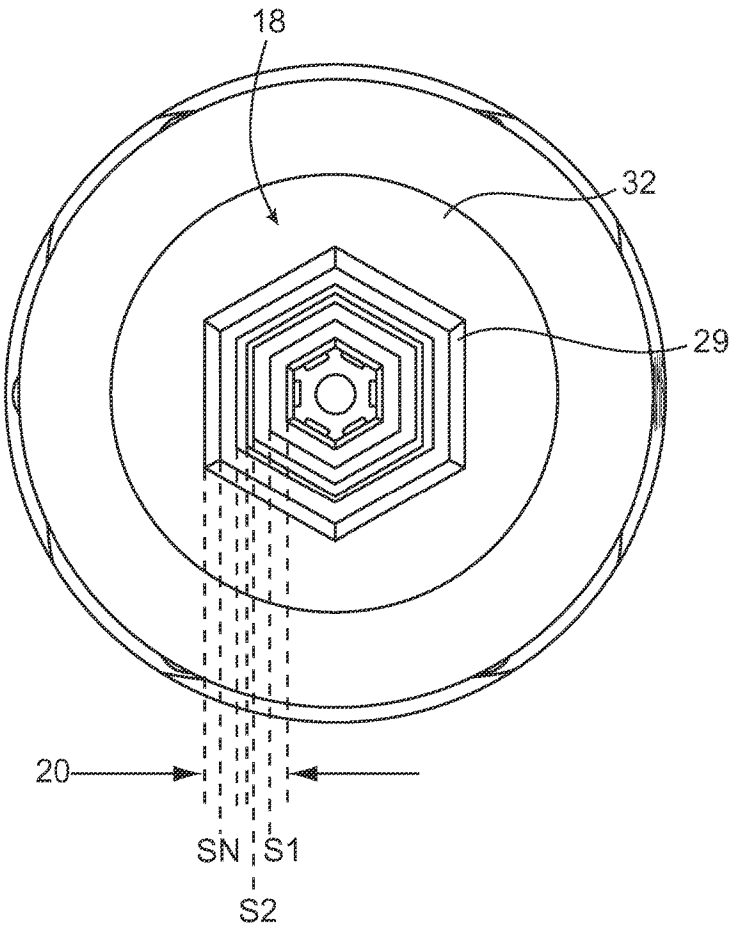
FIG. 3 is a front elevational view of the invention.
Figure 4:
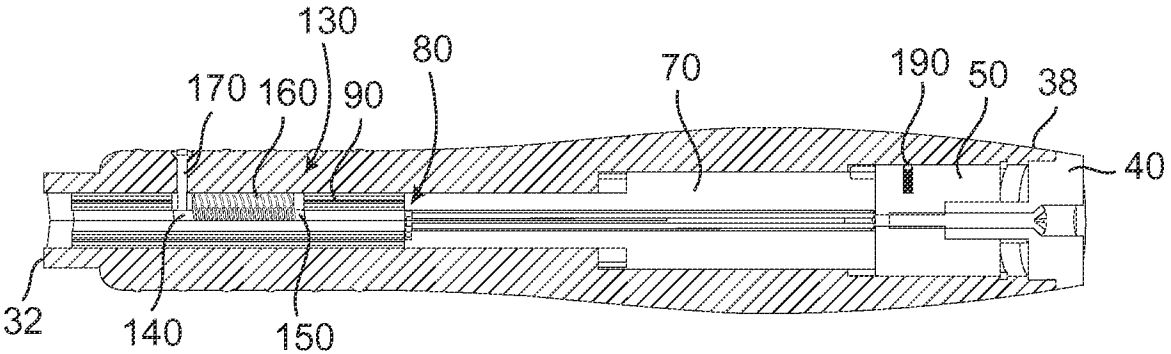
FIG. 4 is a cross-sectional view of the invention along the longitudinal axis thereof and bisecting a set screw thereof.

FIGS. 1 and 4 illustrate a nut driver 10 for driving a nut 15 within a range 20 (FIG. 3) of nut sizes all having a consistent perimeter shape 18. For example, the perimeter shape 18 may be a hexagon for driving a hexagonal nut 15, herein understood to refer to a nut, bolt, or other hexagon-shaped fastener. Alternately, the perimeter shape may be square (not shown), or any other suitable shape.

A rigid elongated housing 30 has a driver end 32 and a selector end 38. The driver end 32 is open and assumes a first largest size 29 of the perimeter shape 18. The selector end 38 terminates in a rotational knob 40 that is positionable at any of a number of selectable radial positions 45, each of which are associated with a different nut size $S_n$ within the range 20 of nut sizes. The housing 30 may include a high-friction grip 180 fixed with at least a portion of an outside surface 37 thereof (FIG. 1). The housing 30 may be formed from a metal casting process and include two shells (not shown), or may be formed from a plastic molding process.

Figure 2A:
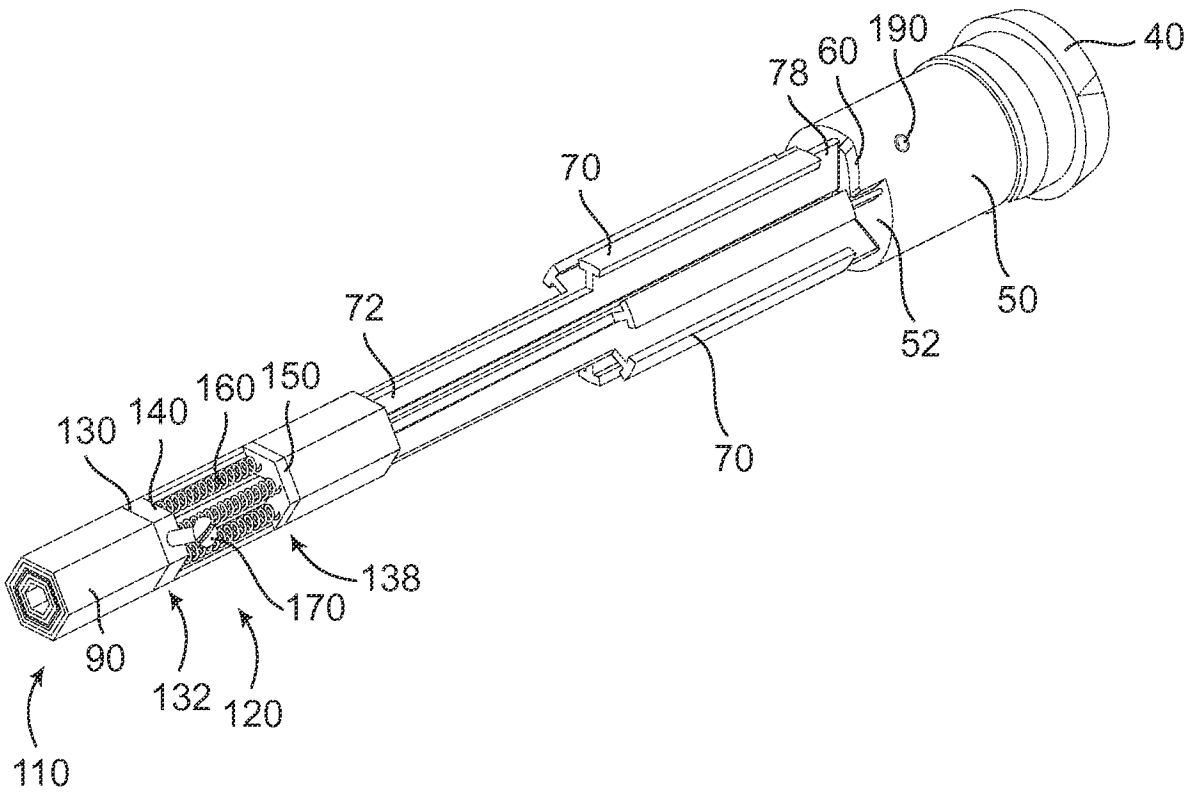
FIG. 2A is a perspective view of the invention, illustrated with a housing removed for clarity of design, and showing a plurality of nested sockets each in a rearward position.
Figure 2B:
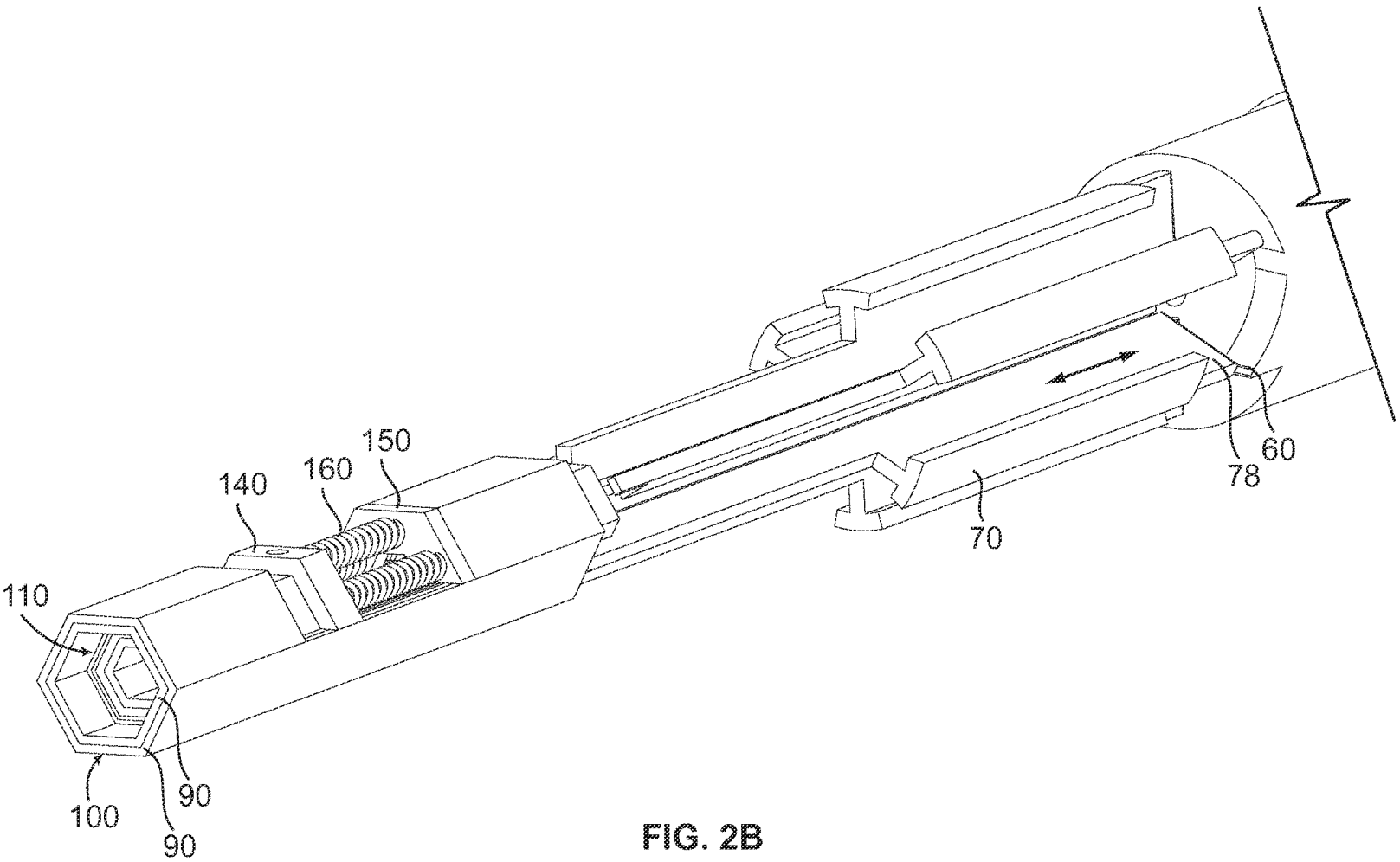
FIG. 2B is an enlarged perspective view of FIG. 2A, but with the outermost two nested sockets illustrated in the forward position.
Figure 5A:
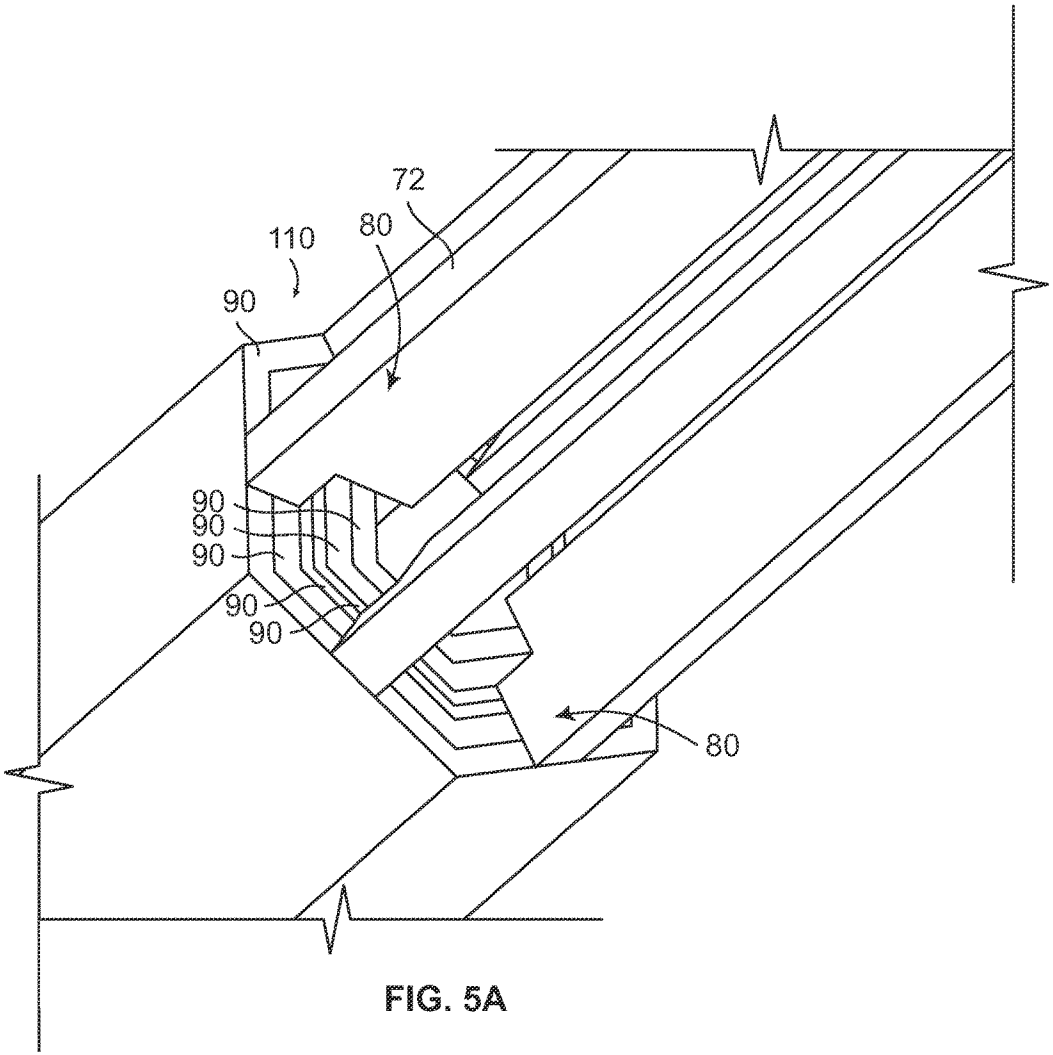
FIG. 5A is an enlarged perspective view of a forward end of a plurality of plungers of the invention, each of which engages a different number of the sockets with a notched socket selector, each of the sockets illustrated in their rearward position corresponding to FIG. 2A.
Figure 5B:
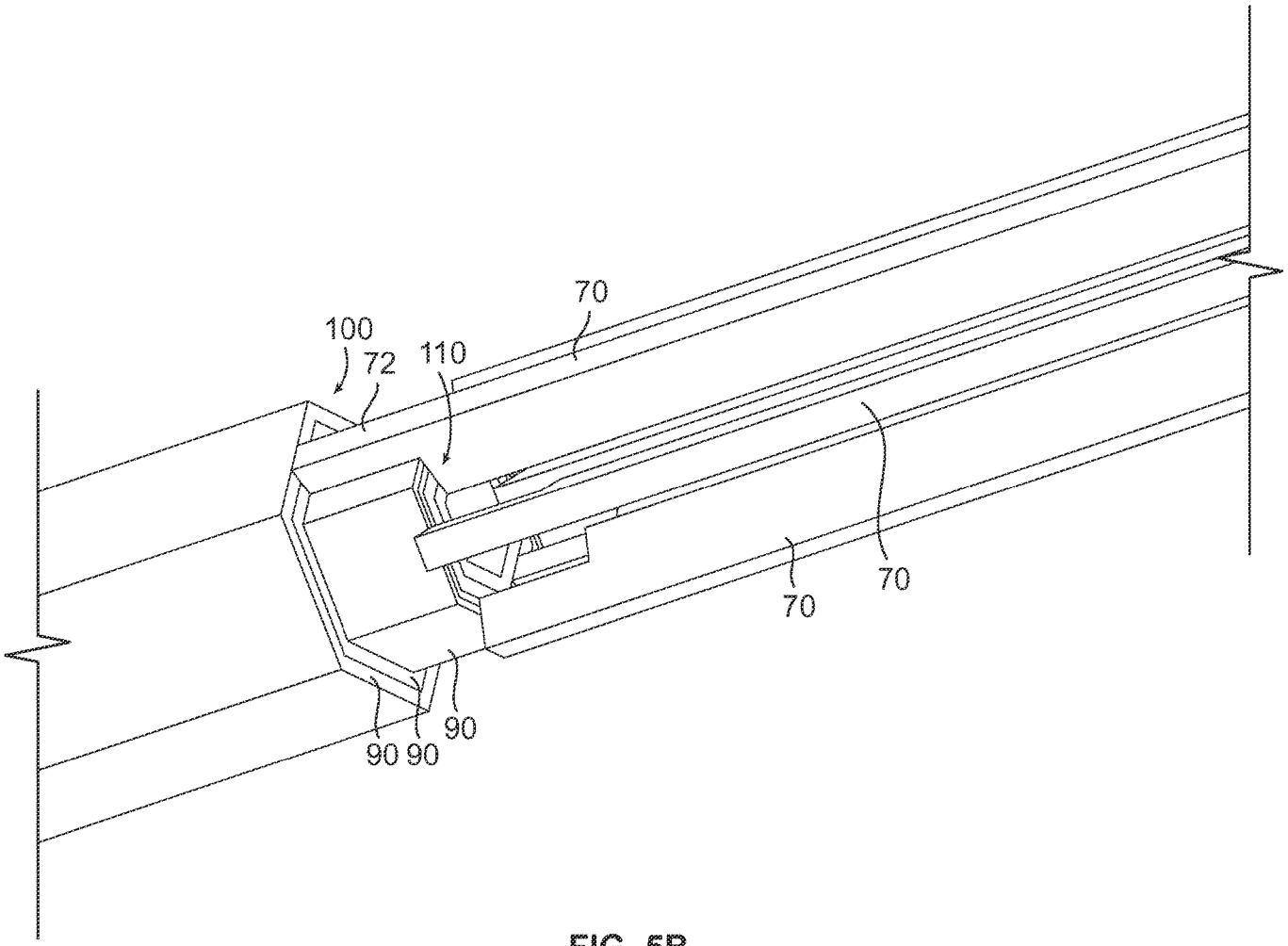
FIG. 5B is an enlarged perspective view of FIG. 5A, but with one of the plungers pushing two of the nested sockets into their forward position corresponding to FIG. 2B.
Figure 6:
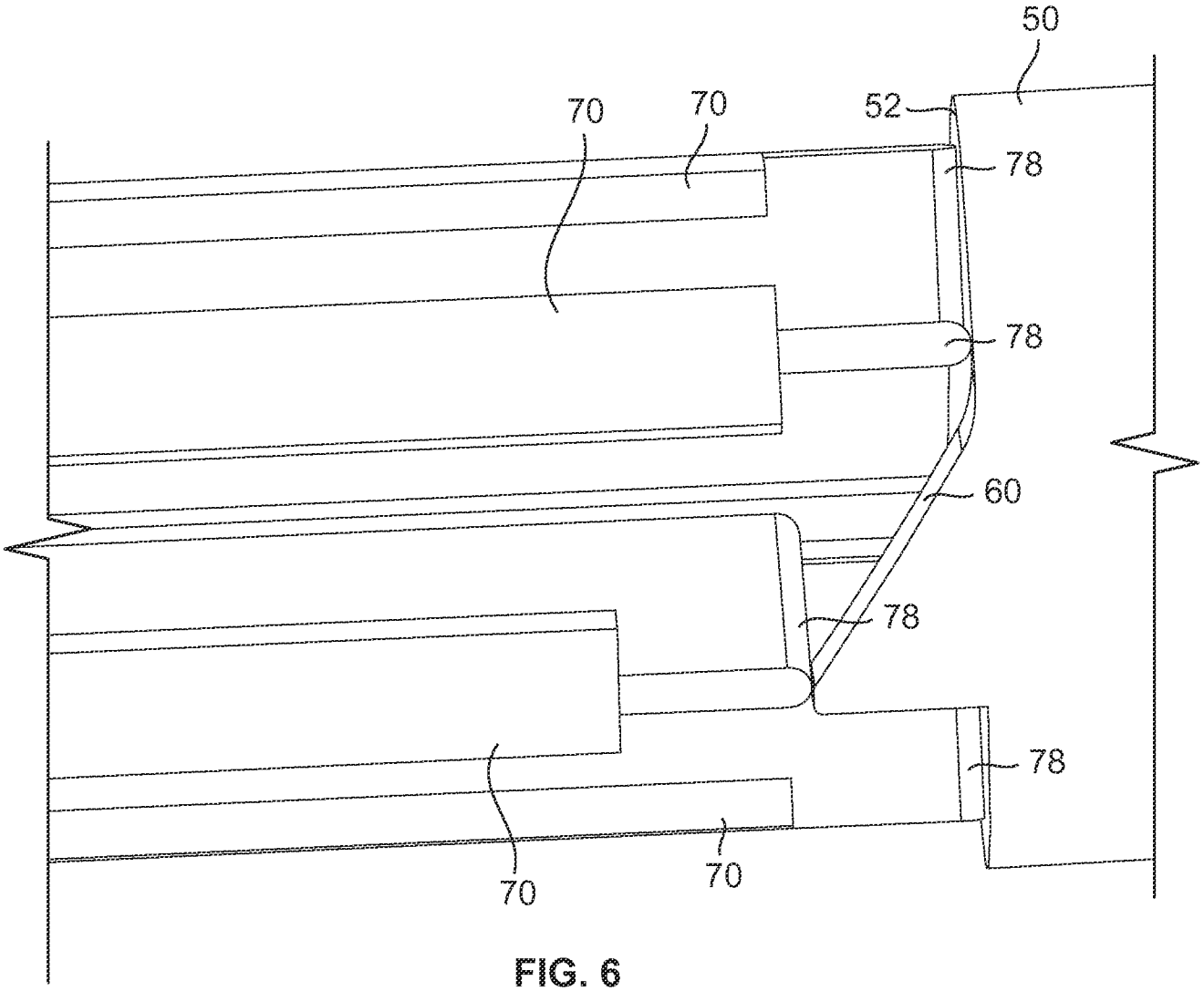
FIG. 6 is an enlarged perspective view of a selector ramp of a rotatable cam illustrated pushing one of the plungers forward, corresponding to FIGS. 2B and 5B.

A cam 50 (FIGS. 2A, 2B and 6) is rotationally fixed with the rotational knob 40 and within the housing 30. The cam 50 terminates at a forward end 52 with a selector ramp 60. The cam 50 is preferably made from a rigid plastic material. The cam 50 may further include a spring detent mechanism 190 that is urged into recesses of the enclosure 30 that correspond to each selectable radial position 45 (FIGS. 2 and 5).

A plurality of elongated plungers 70 are each slidably fixed within the housing 30. Each plunger 70 is adapted at a rear end 78 thereof for engagement with the selector ramp 60 of the cam 50. Each plunger 70 terminates at a forward end 72 (FIGS. 5A, 5B) thereof at a notched socket selector 80. Each plunger 70 is preferably made from a rigid plastic material.

A plurality of nested sockets 90, such as six nested rigid, metal sockets, each have the perimeter shape 18 and one of the different nut sizes $S_n$ within the range 20 of nut sizes. Each socket 90 is slidably movable by at least one of the elongated plungers between a forward position 100 locating a first end of the respective socket 90 within the open driver end 32 of the housing 30 and a rearward position 110.

Preferably the nut driver 10 further includes a spring mechanism 120 fixed with each of the sockets 90 and adapted to urge each of the sockets 90 into the rearward position 110. The spring mechanism 120 may include a notch 130 formed within each of the sockets 90, a stationary plate 140 fixed with the housing 30 and positioned in a forward end 132 of each notch 130, and a pressure plate 150 positioned in a rearward end 138 of each notch 130 (FIG. 2A). At least one spring 160 is fixed between each plate 140,150 such that each spring 160 urges the pressure plate 150 rearward to engage each socket 90 and urge each socket 90 into the rearward position 110. The cam 50 when urging one of the plungers 70 forward to extend one or more of the sockets 90 into the forward position 100 overcomes the force of each spring 160. The stationary plate 140 may be fixed with the housing 30 with a set screw 170 (FIGS. 1 and 2A) traversing the housing 30 and at least partially through the stationary plate 140.

In use, the rotational knob 40 is turned from one of the selectable radial positions 45 to the next, the selector ramp 60 engaging one of the plungers 70 to push one or more of the outermost nested sockets 90 into their forward positions 100 within the open driver end 32 of the housing.

While a particular form of the invention has been illustrated and described, it will be apparent that various modifications can be made without departing from the spirit and scope of the invention. For example, while six nested sockets 90 and plungers 70 are illustrated in the drawings, any suitable number could be used, such as two through twelve, for example. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A nut driver for driving a nut within a range of nut sizes all having a consistent perimeter shape, comprising:

a rigid, elongated housing have a driver end and a selector end, the driver end open and assuming a first size of the perimeter shape, the selector end terminating in a rotational knob positionable at any of a number of selectable radial positions each associated with a different nut size within the range of nut sizes;

a cam rotationally fixed on the rotational knob for rotation within the housing, the cam terminating at a forward end with a selector ramp;

a plurality of elongated plungers each slidably positioned within the housing, adapted at a rear end thereof for engagement with the selector ramp of the cam, and terminating at a forward end thereof at a notched socket selector;

a plurality of nested sockets each having the perimeter shape and size of one of the different nut sizes within the range of nut sizes and smaller than the first size of the open driver end, each socket being slidably movable by at least one of the elongated plungers between a forward position locating a first end of the respective sockets within the open driver end of the housing and a rearward position spaced from the open driver end;

whereby as the rotational knob is turned from one of the selectable radial 22 positions to the next, the selector ramp engages one of the plungers to push one or more of the outermost nested sockets into the forward position.

2. The nut driver of claim 1 further including a spring mechanism engaging each of the sockets and adapted to urge each of the sockets into the rearward position.

3. The nut driver of claim 2 wherein the spring mechanism includes a notch formed within each of the sockets, a stationary plate fixed with the housing and positioned in a forward end of the notch, a pressure plate positioned in a rearward end of the notch, and at least one spring therebetween, the spring urging the pressure plate rearward to engage each socket and urge each socket into the rearward position, the cam when urging one of the plungers forward to extend one or more of the sockets into the forward position overcoming the spring tension.

4. The nut driver of claim 3 wherein the stationary plate is fixed with the housing with a set screw traversing through the housing and at least partially through the stationary plate.

5. The nut driver of claim 1 wherein the plurality of nested sockets includes six nested sockets, and wherein the plurality of plungers includes six plungers.

6. The nut driver of claim 1 wherein the housing includes a high-friction grip fixed with at least a portion of an outside surface thereof.

7. The nut driver of claim 1 wherein the perimeter shape of the nut is a hexagon.

8. The nut driver of claim 1 wherein the housing is formed from a metal casting process and is formed as two shells fixed together.

9. The nut driver of claim 1 wherein the housing is formed from a plastic molding process, and wherein the nested sockets are each made from a rigid metal material.

* * * * *